US008364061B2

(12) United States Patent
Nanno

(10) Patent No.: US 8,364,061 B2
(45) Date of Patent: Jan. 29, 2013

(54) FIXING DEVICE AND IMAGE FORMING APPARATUS

(75) Inventor: Shigeo Nanno, Kyoto (JP)

(73) Assignee: Ricoh Company, Limited, Tokyo (JP)

( * ) Notice: Subject to any disclaimer, the term of this patent is extended or adjusted under 35 U.S.C. 154(b) by 1020 days.

(21) Appl. No.: 12/155,918

(22) Filed: Jun. 11, 2008

(65) Prior Publication Data

US 2009/0010680 A1 Jan. 8, 2009

(30) Foreign Application Priority Data

Jul. 4, 2007 (JP) ..... 2007-176574

(51) Int. Cl.
*G03G 15/16* (2006.01)

(52) U.S. Cl. ..... 399/122

(58) Field of Classification Search ..... 399/122
See application file for complete search history.

(56) References Cited

U.S. PATENT DOCUMENTS

| | | | | |
|---|---|---|---|---|
| 4,782,359 | A * | 11/1988 | Tomoe | 399/122 |
| 5,579,097 | A * | 11/1996 | Tomoe et al. | 399/323 |
| 5,956,547 | A * | 9/1999 | Kamei et al. | 399/122 |
| 6,173,145 | B1 * | 1/2001 | Chadani et al. | 399/265 |
| 6,292,638 | B1 * | 9/2001 | Nagamine et al. | 399/122 |
| 6,697,589 | B1 * | 2/2004 | Dunning et al. | 399/122 |
| 7,974,558 | B2 * | 7/2011 | Choi et al. | 399/258 |
| 8,095,041 | B2 * | 1/2012 | Nanno et al. | 399/122 |
| 2006/0147226 | A1 * | 7/2006 | Sato et al. | 399/122 |
| 2007/0065201 | A1 | 3/2007 | Fujiwara et al. | |
| 2007/0172255 | A1 | 7/2007 | Nanno et al. | |
| 2007/0273085 | A1 | 11/2007 | Nanno et al. | |
| 2007/0279888 | A1 | 12/2007 | Nanno et al. | |
| 2007/0285701 | A1 | 12/2007 | Ohta et al. | |
| 2008/0006166 | A1 | 1/2008 | Ohkubo et al. | |
| 2008/0240781 | A1 * | 10/2008 | Murano | 399/122 |
| 2009/0060571 | A1 * | 3/2009 | Kang | 399/122 |
| 2009/0263155 | A1 * | 10/2009 | Murano | 399/107 |
| 2010/0254728 | A1 * | 10/2010 | Iwase et al. | 399/122 |
| 2011/0211871 | A1 * | 9/2011 | Mori | 399/297 |

(Continued)

FOREIGN PATENT DOCUMENTS

| | | | |
|---|---|---|---|
| JP | 02079872 | A * | 3/1990 |
| JP | 08-305205 | | 11/1996 |

(Continued)

OTHER PUBLICATIONS

English machine translation of Japanese patent document Horioka (JP 2003-241615).*

(Continued)

*Primary Examiner* — David Gray
*Assistant Examiner* — Geoffrey Evans
(74) *Attorney, Agent, or Firm* — Harness, Dickey & Pierce, P.L.C.

(57) ABSTRACT

An engaging unit engages a housing of a fixing device with a main body of an image forming apparatus in an engaged position, and disengages the housing from the main body in a disengaged position. An operating member operates the engaging unit from the engaged position to the disengaged position or vice versa. A holding recession is formed on at least one corner between a front side and a lateral side of the housing. The operating member and the holding recession form a handling unit with which the housing is supported when the housing is attached to or detached from the main body.

17 Claims, 15 Drawing Sheets

U.S. PATENT DOCUMENTS

2012/0027462 A1* 2/2012 Nozawa ..... 399/122
2012/0082478 A1* 4/2012 Wang ..... 399/110

FOREIGN PATENT DOCUMENTS

JP 2003-241615 8/2003
JP 2005321580 A * 11/2005
JP 2006-162997 6/2006

OTHER PUBLICATIONS

Japanese Office Action mailed Feb. 13, 2012 for corresponding Japanese Application No. 2007-176574.

* cited by examiner

FIXING DEVICE AND IMAGE FORMING APPARATUS

CROSS-REFERENCE TO RELATED APPLICATIONS

The present application claims priority to and incorporates by reference the entire contents of Japanese priority document 2007-176574 filed in Japan on Jul. 4, 2007.

BACKGROUND OF THE INVENTION

1. Field of the Invention

The present invention relates to a fixing device and an image forming apparatus.

2. Description of the Related Art

A fixing device is used in an image forming apparatus to fix a toner image to a recording medium, such as a transfer sheet or an overhead projector (OHP) sheet, (hereinafter, "sheet"). The image forming apparatus is, for example, a copy machine, a printer, a facsimile, or a multifunction product. Some fixing devices are detachable from the main body of the image forming apparatus. With this configuration, the fixing device can be easily replaced or repaired. For example, Japanese Patent Application Laid-open No. H8-305205 and Japanese Patent Application Laid-open No. 2006-162997 disclose technologies for attaching/detaching the fixing device to/from the main body of the image forming apparatus.

In Japanese Patent Application Laid-open No. H8-305205, a handle is mounted on the top of the main body of the fixing device (housing) in a protruding manner. When the handle is pulled upward, the fixing device is detached from the main body of the image forming apparatus.

In Japanese Patent Application Laid-open No. 2006-162997, a supporting shaft that protrudes upward from the main body of the fixing device is provided, and a handle is mounted on the upper end of the protruded supporting shaft. The lower end of the supporting shaft is interlocked with a locking mechanism. The locking mechanism engages the fixing device with the main body of the image forming apparatus. When the handle is rotated, the supporting shaft is rotated around a rotation axis, and thereby the locking mechanism is switched between an engaged state and a disengaged state. After the handle is rotated, and the locking mechanism is switched to the disengaged state, the fixing device is detached from the image forming apparatus by pulling up the handle.

However, in Japanese Patent Application Laid-open No. H8-305205 and Japanese Patent Application Laid-open No. 2006-162997, the handle must considerably protrude from the main body. Therefore, a large space is required for arranging the fixing device in the image forming apparatus. Furthermore, when the fixing device is attached to or detached from the image forming apparatus, the user needs to support the weight of the fixing device with only the handle. Such an operation can be unstable, and the handle can be damaged.

SUMMARY OF THE INVENTION

It is an object of the present invention to at least partially solve the problems in the conventional technology.

According to an aspect of the present invention, there is provided a fixing device that fixes a toner image to a recording medium. The fixing device includes a housing configured to be detachably attached to a main body of an image forming apparatus; an engaging unit that is provided to the housing and capable of moving from an engaged position to a disengaged position, wherein the engaging unit engages the housing with the main body in the engaged position and disengages the housing from the main body in the disengaged position; an operating member that is provided to the housing for operating the engaging unit from the engaged position to the disengaged position or vice versa; and a holding recession formed on at least one corner between a front side and a lateral side of the housing with respect to a direction to which the housing is attached to or detached from the main body. The operating member and the holding recession form a handling unit with which the housing is supported when the housing is attached to or detached from the main body.

According to another aspect of the present invention, there is provided an image forming apparatus that includes the above fixing device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
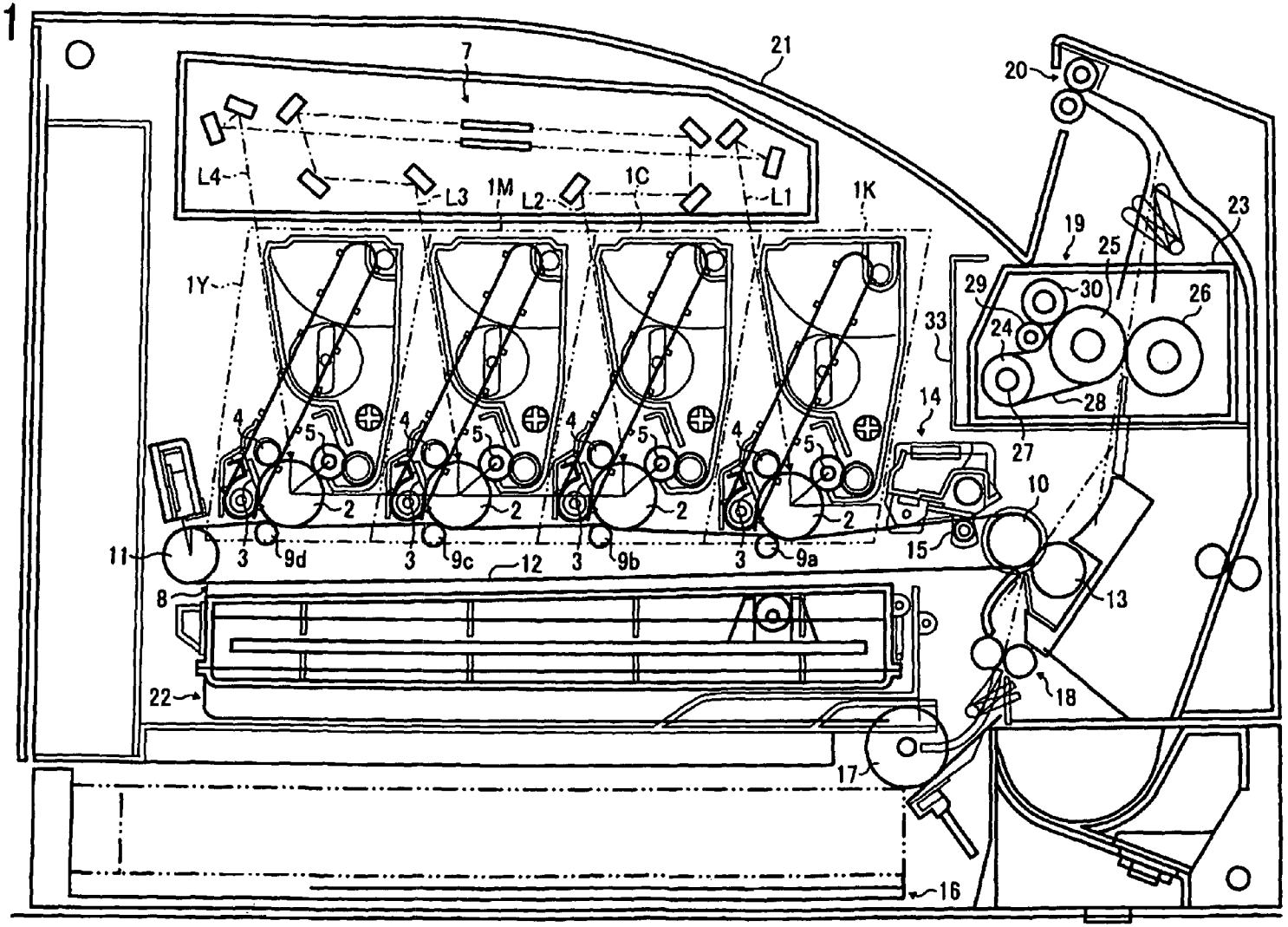
FIG. 1 is a schematic diagram of an image forming apparatus including a fixing device according to a first embodiment of the present invention.

FIG. 1 is a schematic diagram of an image forming apparatus including a fixing device according to a first embodiment of the present invention. The image forming apparatus includes four process units 1K, 1C, 1M, and 1Y. The process units 1K, 1C, 1M, and 1Y forms a color image by using developers of four primary colors, i.e., black, cyan, magenta, and yellow.

The process units 1K, 1C, 1M, and 1Y have the same configuration except that they contain toner of different colors. The process unit 1K will be described as an example. The process unit 1K includes an image carrier 2, a cleaning unit 3, a charging unit 4, and a developing unit 5. The process unit 1K is detachably attached to a main body of the image forming apparatus.

An exposure device 7 is arranged above the process units 1K, 1C, 1M, and 1Y. In the exposure device 7, laser beams L1 to L4 are emitted from laser diodes (not shown) based on image data.

A transfer belt device 8 is arranged under the process units 1K, 1C, 1M, and 1Y. The transfer belt device 8 includes an intermediate transfer belt 12. The toner image formed on the image carrier 2 is transferred to the intermediate transfer belt 12. The intermediate transfer belt 12 is supported and rotated by four primary transfer rollers 9*a*, 9*b*, 9*c*, 9*d*, a drive roller 10, a supporting roller 11, and a cleaning backup roller 15. The primary transfer rollers 9*a*, 9*b*, 9*c*, 9*d* are faced to the image carriers 2 of the process units 1K, 1C, 1M, 1Y. A secondary transfer roller 13 is arranged to face the drive roller 10. A belt cleaning device 14 is arranged to face the cleaning backup roller 15.

A feeding cassette 16 and a feeding roller 17 are arranged at the bottom of the image forming apparatus. The feeding cassette 16 can contain multiple sheets. The feeding roller 17 feeds a sheet from the feeding cassette 16. A pair of registration rollers 18 is mounted between the feeding roller 17 and a nip formed between the secondary transfer roller 13 and the drive roller 10. The registration rollers 18 temporarily stop the sheet.

A fixing device 19 is arranged above the nip between the secondary transfer roller 13 and the drive roller 10. The fixing device 19 includes a housing 23 made of a resin. The housing 23 is detachably attached to a holding frame member 33 made of metal. The holding frame member 33 is mounted on the main body of the image forming apparatus. A heating roller 24, a fixing roller 25, and a pressure roller 26 are rotatably mounted in the housing 23. An endless fixing belt 28 is supported by the heating roller 24 and the fixing roller 25. When the fixing roller 25 rotates, the fixing belt 28 and the heating roller 24 shown in FIG. 1 rotate in a counterclockwise direction. The heating roller 24 includes a heat source 27. The heating roller 24 and the fixing belt 28 are heated by heat generated by the heat source 27. In the first embodiment, a halogen heater is used as the heat source 27. However, an induction heating method can be employed.

The pressure roller 26 is movably supported, so that the pressure roller 26 can abut with or separate from the fixing roller 25. The pressure roller 26 is pressed against the fixing belt 28 while the pressure roller 26 is close to the fixing roller 25. The portion where the fixing roller 25 abuts the fixing belt 28 functions as a fixing nip. The pressure roller 26 rotates (in a clockwise direction) with the rotation of the fixing belt 28. Reference numerals 29 and 30 denote a belt supporting roller, and a belt cleaning roller, respectively.

A pair of discharging rollers 20 is arranged above the fixing device 19. The discharging rollers 20 discharge the sheet out of the image forming apparatus. The discharged sheet is stacked on a catch tray 21. The catch tray 21 is formed by curving a part of the upper surface of the main body of the image forming apparatus in an inward direction.

A waste-toner collecting case 22 is arranged between the transfer belt device 8 and the feeding cassette 16. A waste-toner conveying hose (not shown) extends from the belt cleaning device 14. The waste-toner conveying hose is connected to an inlet of the waste-toner collecting case 22.

When the feeding roller 17 rotates based on a feeding signal from a control unit (not shown) included in the image forming apparatus, the feeding roller 17 feeds a sheet on the top of the sheets stacked on the feeding cassette 16 to the registration rollers 18. When a leading end of the sheet reaches the nip between the registration rollers 18, the registration rollers 18 temporarily stop the sheet to synchronize the timing of the sheet with the timing of forming the toner image on the intermediate transfer belt 12.

The structure and the operation of the process unit 1K will be described below as an example. The charging unit 4 uniformly charges the surface of the image carrier 2 to a high electric potential. The exposure device 7 causes the laser beam L1 to be emitted to a portion on the surface of the image carrier 2 based on image data. An electric potential of the portion then decreases, and thereby an electrostatic latent image is formed on the portion. The developing unit 5 transfers toner onto the portion on which the electrostatic latent image is formed, thereby forming (developing) a black toner image. The toner image formed on the image carrier 2 is then transferred to the intermediate transfer belt 12. Each of the process units 1C, 1M, 1Y performs the same processes as described above to form a toner image on the image carrier 2. Thus, the toner images of four colors are transferred and superimposed onto the intermediate transfer belt 12.

The cleaning unit 3 of each of the process units 1K, 1C, 1M, 1Y removes toner remaining on the surface of the image carrier 2 after the process of transferring the toner image to the intermediate transfer belt 12 is finished. After the cleaning unit 3 cleans the image carrier 2, a charge removing device (not shown) removes residual charge from the image carrier 2.

Afterward, the registration rollers 18 and the feeding roller 17 start to rotate again, thereby feeding the sheet to the secondary transfer roller 13 in such a manner to synchronize the timing of the sheet with the timing of the toner images superimposed on the intermediate transfer belt 12. The secondary transfer roller 13 then transfers the toner images from the intermediate transfer belt 12 to the sheet.

The sheet having the toner images transferred thereto is conveyed to the fixing device 19. The sheet is then sandwiched and pressed between the fixing roller 25 and the pressure roller 26 with heat, so that an unfixed toner image is fixed to the sheet. The sheet having the toner image fixed thereto is conveyed from the fixing device 19 to the discharging rollers 20. The discharging rollers 20 then discharge the sheet to the catch tray 21.

After the toner image is transferred from the intermediate transfer belt 12 to the sheet, remaining toner is attached on the intermediate transfer belt 12. The belt cleaning device 14 removes the remaining toner from the intermediate transfer belt 12. The toner removed from the intermediate transfer belt 12 is conveyed by a waste-toner conveying unit (not shown), and collected in the waste-toner collecting case 22.

Figure 2:
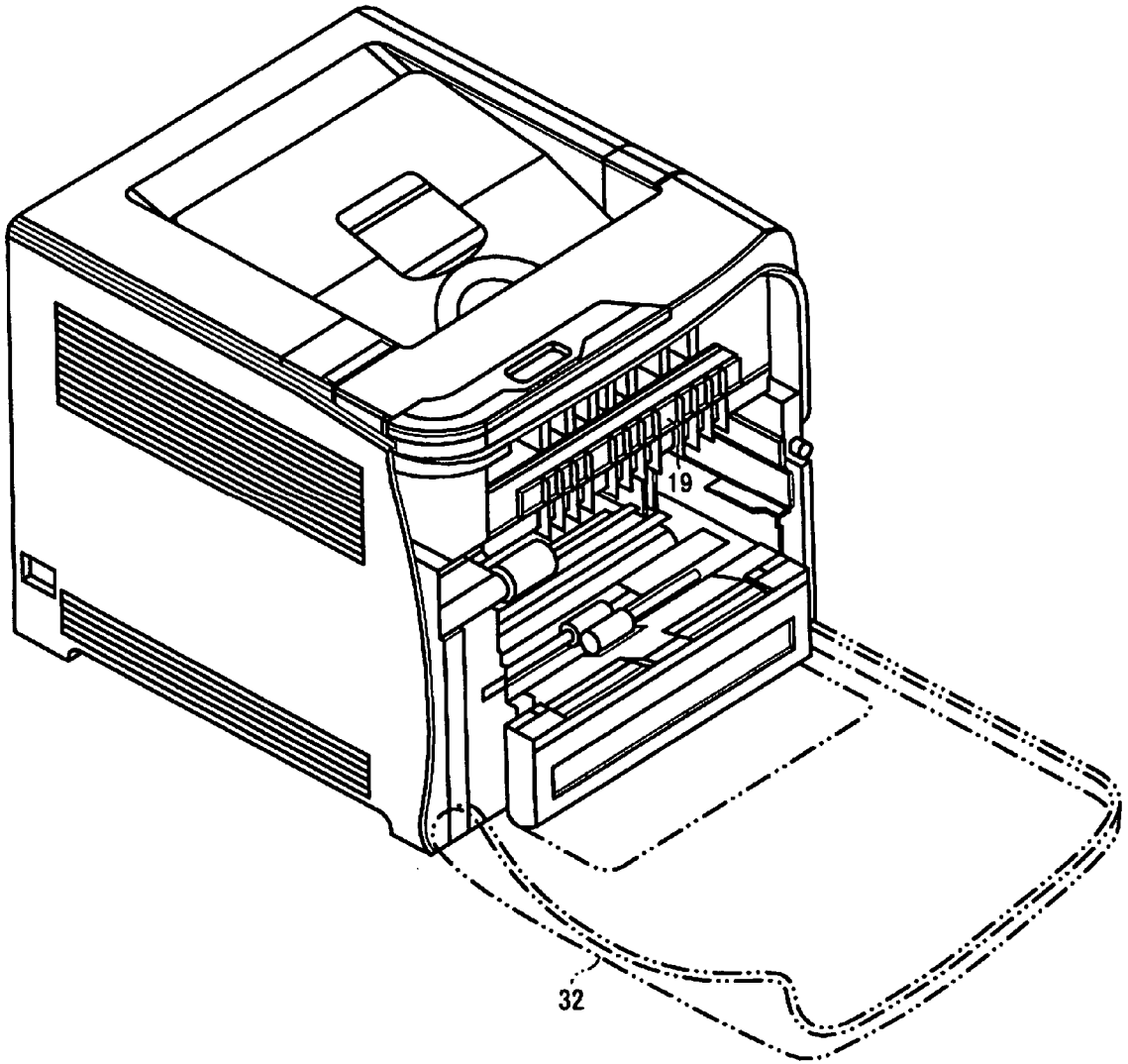
FIG. 2 is a perspective view of the image forming apparatus with a front cover open.

FIG. 2 is a perspective view of the image forming apparatus with a front cover 32 open. The front cover 32 is configured to be opened and closed by swinging around a pivot point that is located at the lower end of the front cover 32. When the front cover 32 is opened, the fixing device 19 is exposed to the outside.

Figure 3:
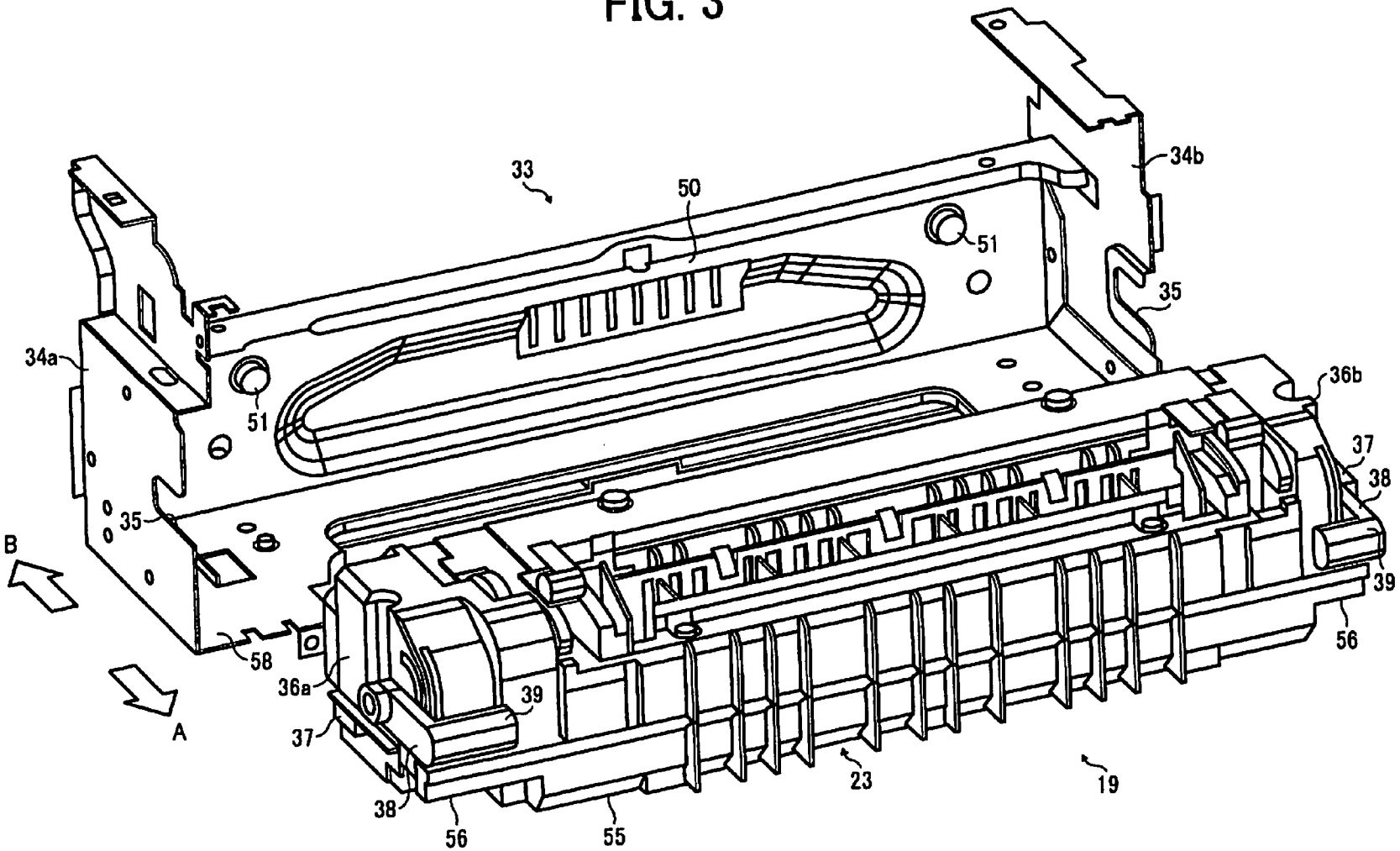
FIG. 3 is a perspective view of a holding frame member of the image forming apparatus and the fixing device according to the first embodiment.
Figure 4:
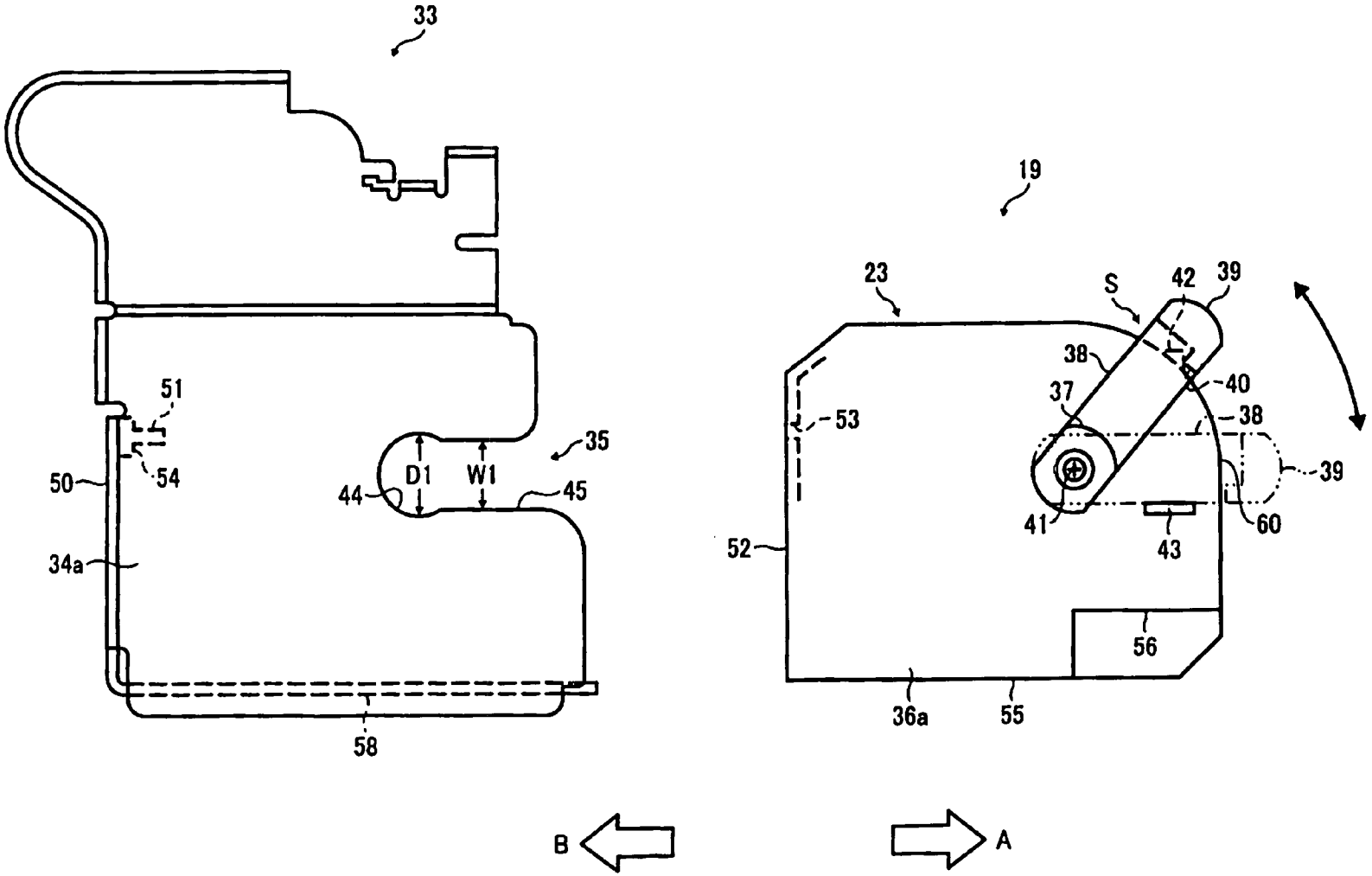
FIG. 4 is a side view of the holding frame member and the fixing device according to the first embodiment.

FIG. 3 is a perspective view of the holding frame member 33 and the fixing device 19. FIG. 4 is a side view of the holding frame member 33 and the fixing device 19. As shown in FIGS. 3 and 4, the fixing device 19 can be detached from the holding frame member 33. Hereinafter, the direction in which the fixing device 19 is pulled to detach from the holding frame member 33 is referred to as a forward direction A, and a reverse direction of the forward direction A is referred to as a backward direction B.

The housing 23 includes side surfaces 36*a* and 36*b*. Switching levers 38, 38 are pivotally mounted on the side surfaces 36*a* and 36*b*, and an end of each of the switching levers 38, 38 can swing up and down. An engaging member 37 (an engaging unit) is mounted around a fulcrum 41 of the switching lever 38 in such a manner that the engaging member 37 protrudes laterally outward. The engaging member 37 engages the housing 23 with the holding frame member 33. The engaging member 37 is rotatable around the fulcrum 41 in accordance with the swing of the switching lever 38.

An operating member 39 is arranged at the end of each of the switching levers 38, 38. The operating member 39 operates the switching lever 38. The operating member 39 extends from the end of the switching lever 38 laterally inward of the housing. The operating member 39 is arranged to face a front surface 60 of the housing 23. When the switching lever 38 swings up and down, the operating member 39 moves in a circular arc shape around the fulcrum 41. The surface of the housing 23 to which the operating member 39 faces is formed to be an arc-shaped surface around the fulcrum 41 corresponding to circular-arc movement of the operating member 39. A predetermined space S (see FIG. 4) is formed between the arc-shaped surface of the housing 23 and the operating member 39, so that the housing 23 and the operating member 39 do not interfere with each other.

An upper stopper 42 is mounted on the arc-shaped surface of the housing 23 in a protruding manner. When the switching lever 38 swings up, a convex contact portion 40 formed on the operating member 39 is in contact with the upper stopper 42. A lower stopper 43 is mounted on the side surface 36*a* of the housing 23 in a protruding manner. When the switching lever 38 swings down, the switching lever 38 is in contact with the lower stopper 43. Furthermore, the switching lever 38 is biased upward by a biasing unit (not shown), such as a torsion coil spring. When the operating member 39 is not operated, the switching lever 38 is held in the swung-up position.

As shown in FIG. 2, the holding frame member 33 is a chassis that is open toward the forward direction A. The holding frame member 33 includes side plates 34*a*, 34*b*. Slits 35, 35 are formed on the side plates 34*a*, 34*b*. As shown in FIG. 4, the slit 35 includes an engagement portion 44 and a guide portion 45. The engagement portion 44 is arranged on the rear side of each of the side plates 34*a*, 34*b*, and is formed into a hole-like shape. The guide portion 45 horizontally extends from the engagement portion 44, and has an opening toward the forward direction A. A diameter D1 of the engagement portion 44 is larger than a width W1 of the guide portion 45.

Figure 5:
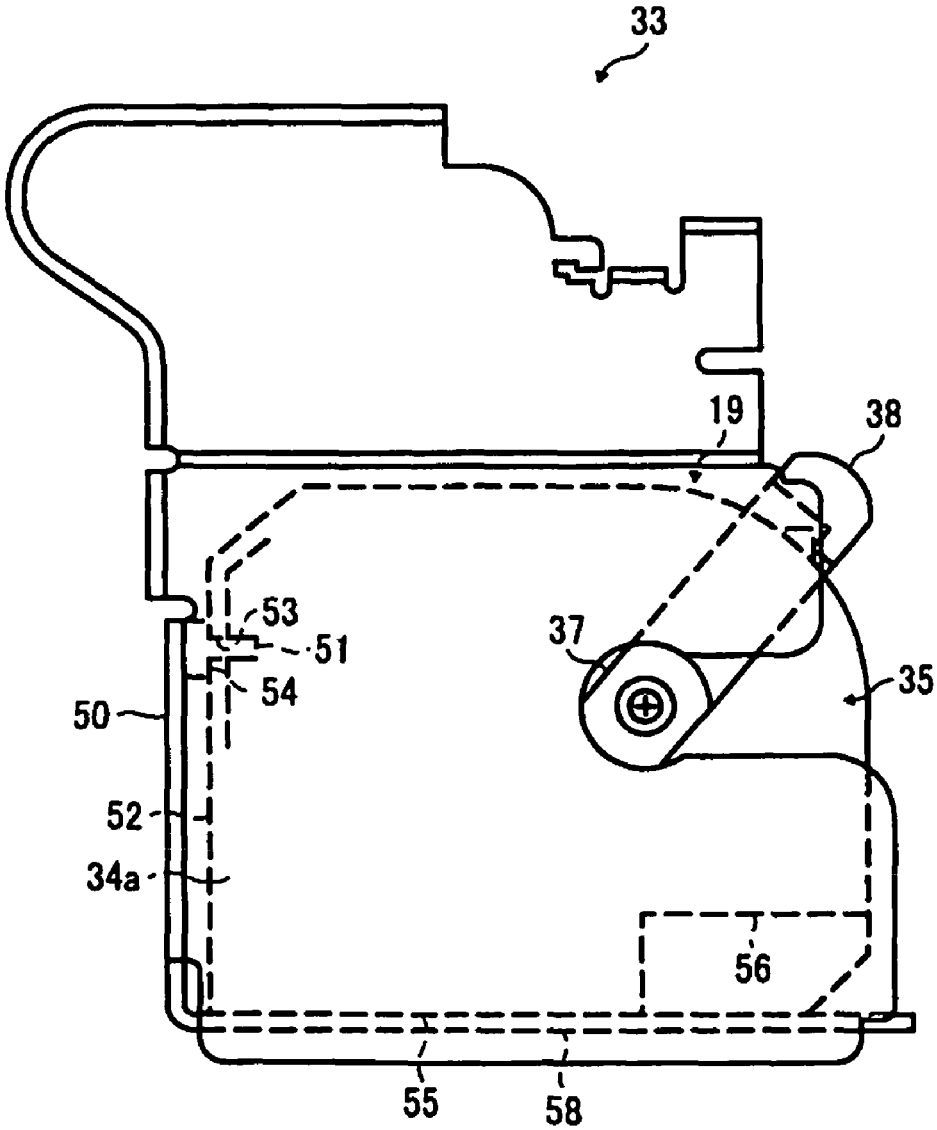
FIG. 5 is a side view of the holding frame member and the fixing device according to the first embodiment with the fixing device attached to the holding frame member.

FIG. 5 is a side view of the holding frame member 33 and the fixing device 19. The fixing device 19 is attached to the holding frame member 33. The engaging member 37 is inserted into the slit 35, thereby engaging the fixing device 19 with the holding frame member 33.

Figure 6A:
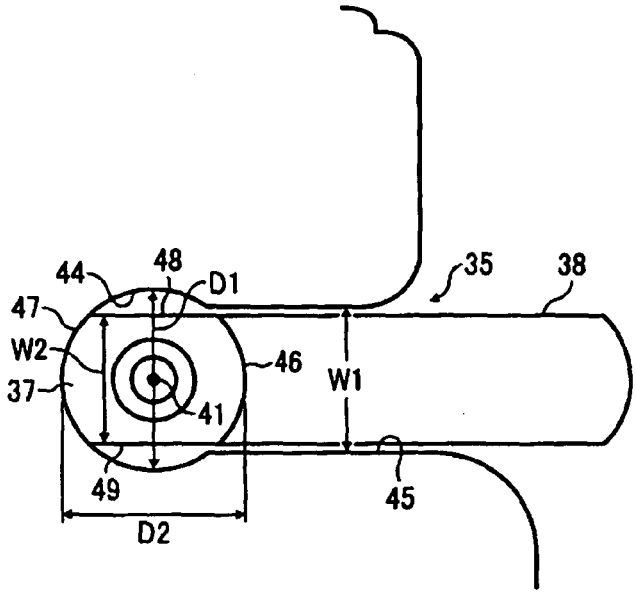
FIGS. 6A and 6B are enlarged side views of an engaging member of the fixing device according to the first embodiment and a slit of the holding frame member.
Figure 6B:
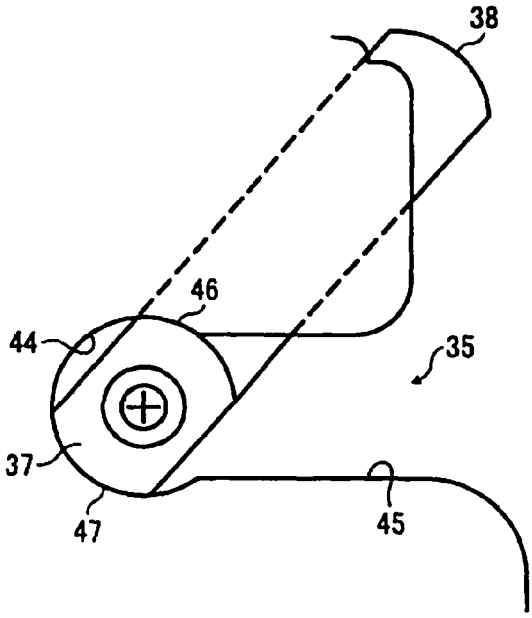

FIGS. 6A and 6B are enlarged side views of the engaging member 37 and the slit 35. As shown in FIG. 6A, the engaging member 37 includes arc-shaped portions 46, 47, and straight portions 48, 49. The arc-shaped portions 46, 47 are faced to each other, and the straight portions 48, 49 face each other. The arc-shaped portions 46 and 47 are arcs of a common circle having the center on the fulcrum 41. A diameter D2 of the common circle is set to be equal to or slightly smaller than the diameter D1 of the engagement portion 44. In this manner, when the switching lever 38 swings, the engaging member 37 can rotate in the engagement portion 44.

A width W2 between the straight portions 48 and 49 is set to be slightly smaller than the width W1 of the guide portion 45. In this manner, when the switching lever 38 swings down, and the engaging member 37 lies horizontally, the engaging member 37 can pass through the guide portion 45. Thus, the engaging member 37 can be attached to or detached from the slit 35.

As shown in FIG. 6B, when the switching lever 38 swings up (by the force of the biasing unit), and the engaging member 37 lies obliquely, the arc-shaped portions 46, 47 engage with the engagement portion 44. Thus, the engaging member 37 cannot be detached from the engagement portion 44. As shown in FIG. 6A, when the switching lever 38 swings down, and the engaging member 37 lies horizontally, the engagement between the engaging member 37 and the engagement portion 44 is released. Specifically, because the engaging member 37 can pass through the guide portion 45, the engaging member 37 can be detached from the engagement portion 44.

As described above, when the switching lever 38 swings up (to an engaged position), the engaging member 37 engages with the engagement portion 44. Thus, the housing 23 engages with the holding frame member 33. When the switching lever 38 swings down (to a disengaged position), the engagement between the engaging member 37 and the engagement portion 44 is released. Thus, the housing 23 can be attached to or detached from the holding frame member 33.

As shown in FIGS. 3 and 4, a pair of positioning pins 51, 51 is formed on the inner surface (the surface toward the forward direction A) of a back plate 50 of the holding frame member 33 in a protruding manner. A pair of positioning holes 53, 53 is formed on a back surface 52 of the housing 23. The positioning pins 51, 51 can be inserted into the positioning holes 53, 53. A contact base 54 is arranged on a base portion of the positioning pin 51 (see FIG. 5). The contact base 54 is in contact with the back surface 52 of the housing 23 when the positioning pin 51 is inserted into the positioning hole 53.

The holding frame member 33 includes a horizontal bottom plate 58. The bottom plate 58 functions as a supporting member that supports a bottom surface 55 of the housing 23 when the fixing device 19 is attached to or detached from the holding frame member 33.

Figure 7:
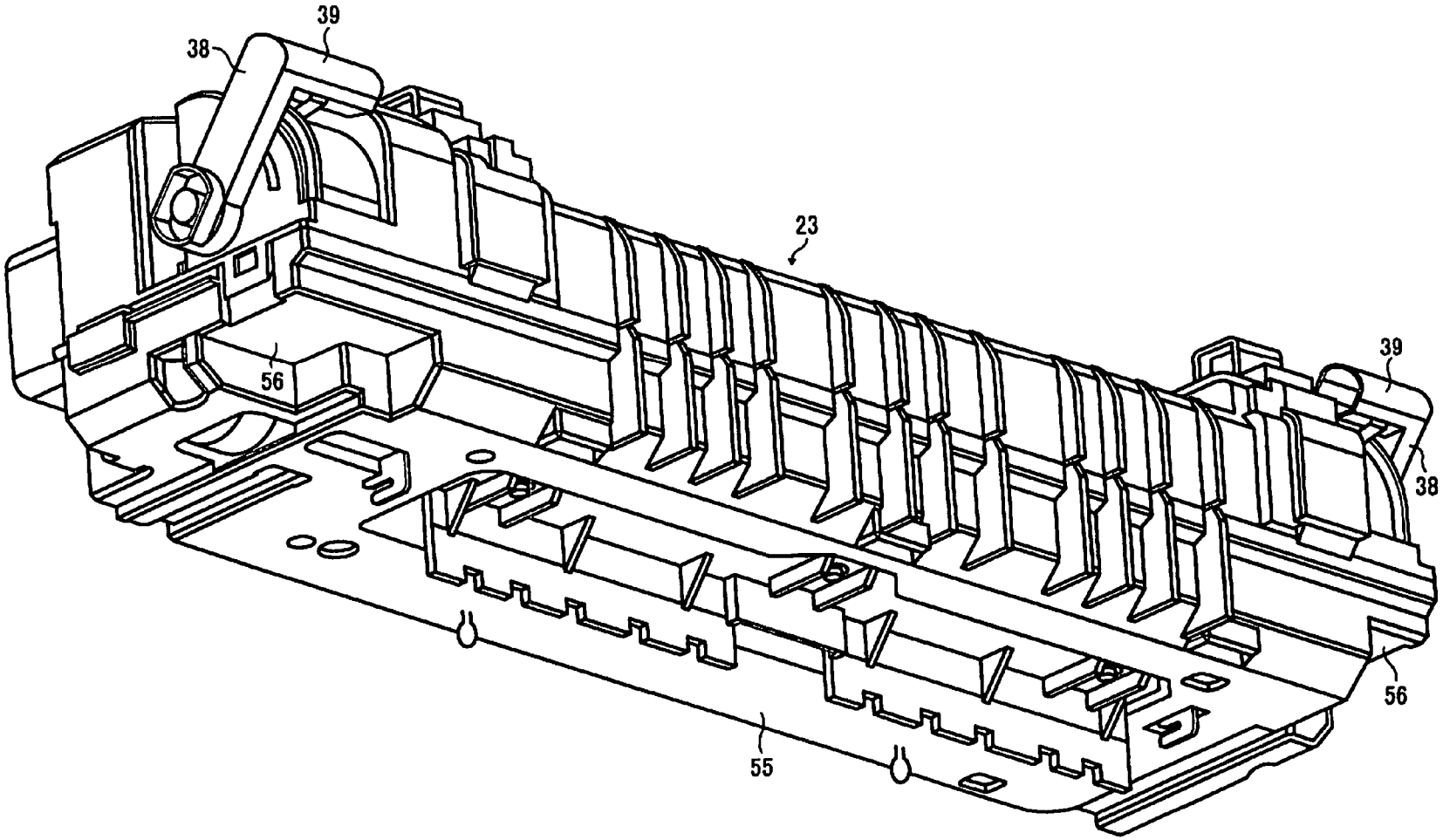
FIG. 7 is a perspective view of the fixing device according to the first embodiment.

FIG. 7 is a perspective view of the fixing device 19. A pair of holding recessions 56, 56 is arranged on the housing 23 for a user to hold the housing 23. Specifically, one of the holding recessions is formed on a corner of the housing 23 among the front side, the bottom side, and a right side, and the other holding recession is formed on another corner among the front side, the bottom side, and a left side. Each of the holding recessions 56, 56 is formed in a flat surface, so that it is easy for the user to hold the housing 23. It can be configured such that a part of the holding recession 56 is formed in a flat surface.

Figure 8:
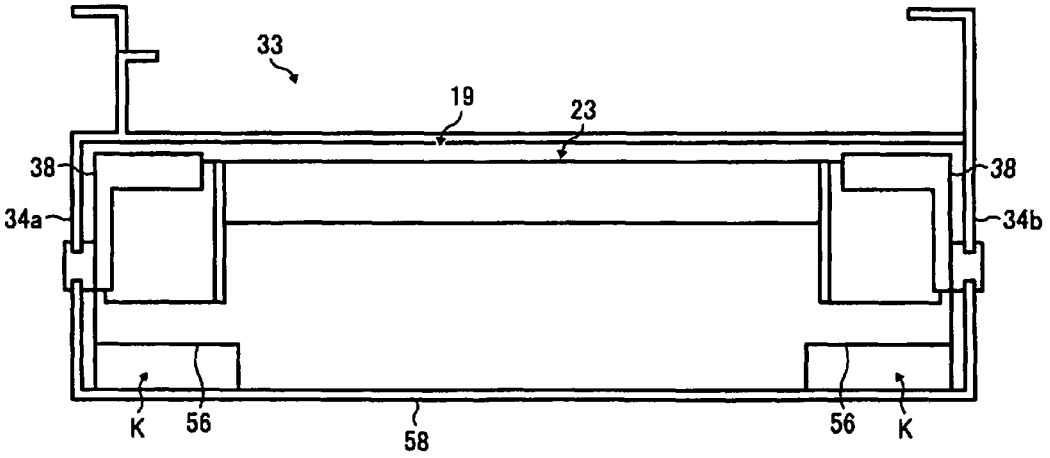
FIG. 8 is a front view of the holding frame member to which the fixing device according to the first embodiment is attached.

FIG. 8 is a front view of the holding frame member 33 to which the fixing device 19 is attached. Spaces K are surrounded by the holding recessions 56, 56, the side plates 34*a*, 34*b*, and the bottom plate 58. Each of the spaces K is set to have a size that allows a user to put the forefingers and the like in the spaces K, so that the user can support the fixing device 19 from the bottom with the forefingers and the like. The user can touch the holding recessions 56 with the fingers while the fixing device 19 is attached to the holding frame member 33.

Figure 9:
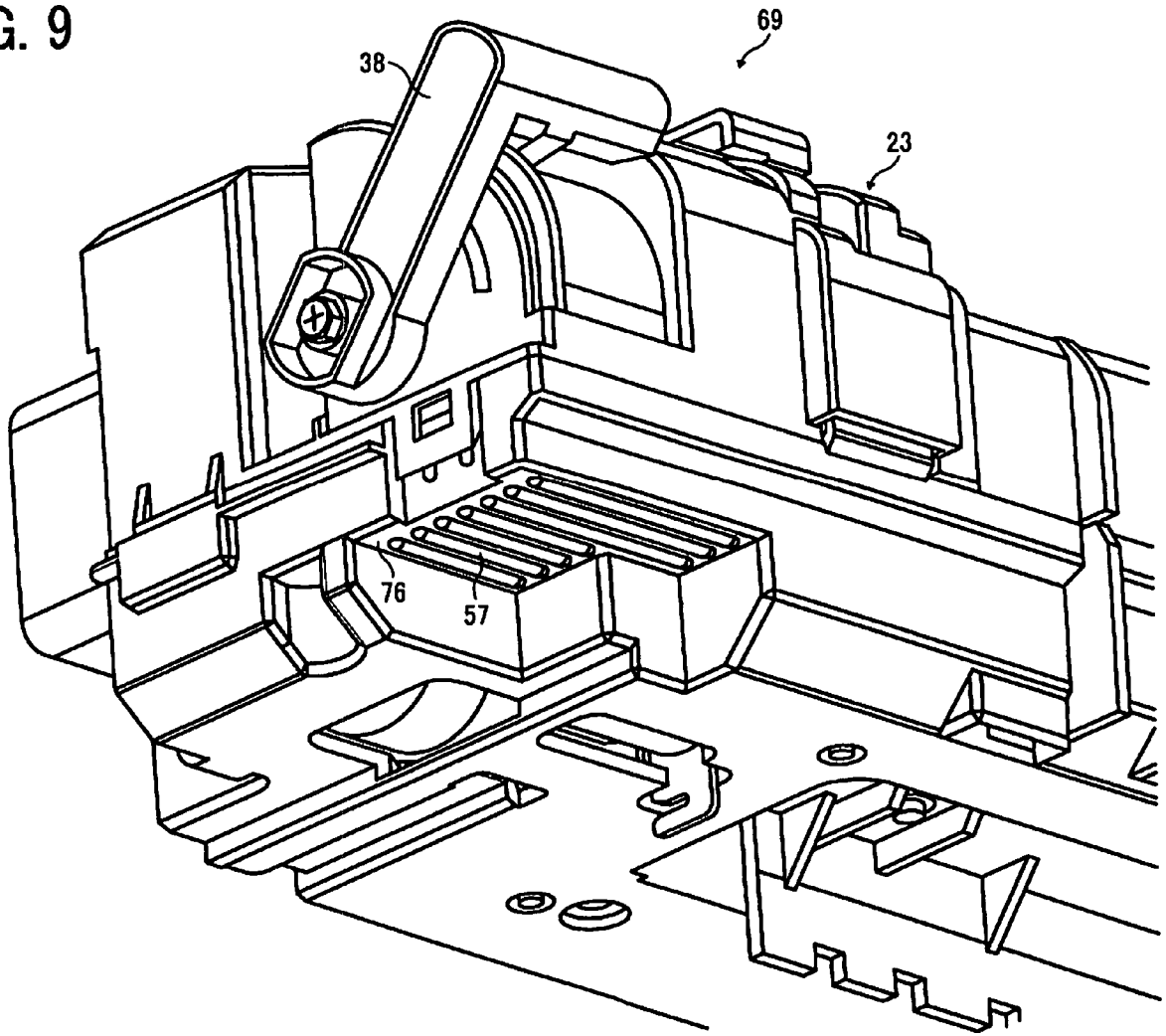
FIG. 9 is a perspective view of a fixing device according to a second embodiment of the present invention.

FIG. 9 is a perspective view of a fixing device 69 according to a second embodiment of the present invention. The fixing device 69 includes a holding recession 76, and a plurality of convex portions 57 is arranged on the holding recession 76. Each of the convex portions 57 is a protruding portion that extends in a direction substantially orthogonal to a direction to which the housing 23 (fixing device 69) is attached to or detached from the holding frame member 33. The convex portions 57 are arranged parallel to each other. Because the convex portions 57 are arranged on the holding recession 76, it is possible to avoid a slip of the finger on the holding recessions 56 when the user holds the holding recession 76. The housing 23 is made of a resin or the like that has a relatively low thermal conductivity. However, the housing 23 may become hot due to heat generated upon a fixing operation performed by the fixing device 19. Even if the holding recession 76 becomes hot due to heating of the housing 23, the heat of the housing 23 is not easily transmitted to the fingers because the user holds the housing 23 with the fingers in contact with the convex portions 57. Therefore, the user can safely hold the housing 23.

A shape of the convex portions 57 is not limited to that shown in FIG. 9, but it can be formed into various shapes. To avoid the slip of the finger, a plurality of concave portions (not shown) can be formed on the holding recession 76 instead of the convex portions 57. Furthermore, a friction member (not shown) or a heat insulating member (not shown) can be attached to the holding recession 76. Moreover, a plurality of convex portions (not shown) or concave portions (not shown) can be formed on the operating member 39. A friction member (not shown) can be arranged on the operating member 39.

Figure 10:
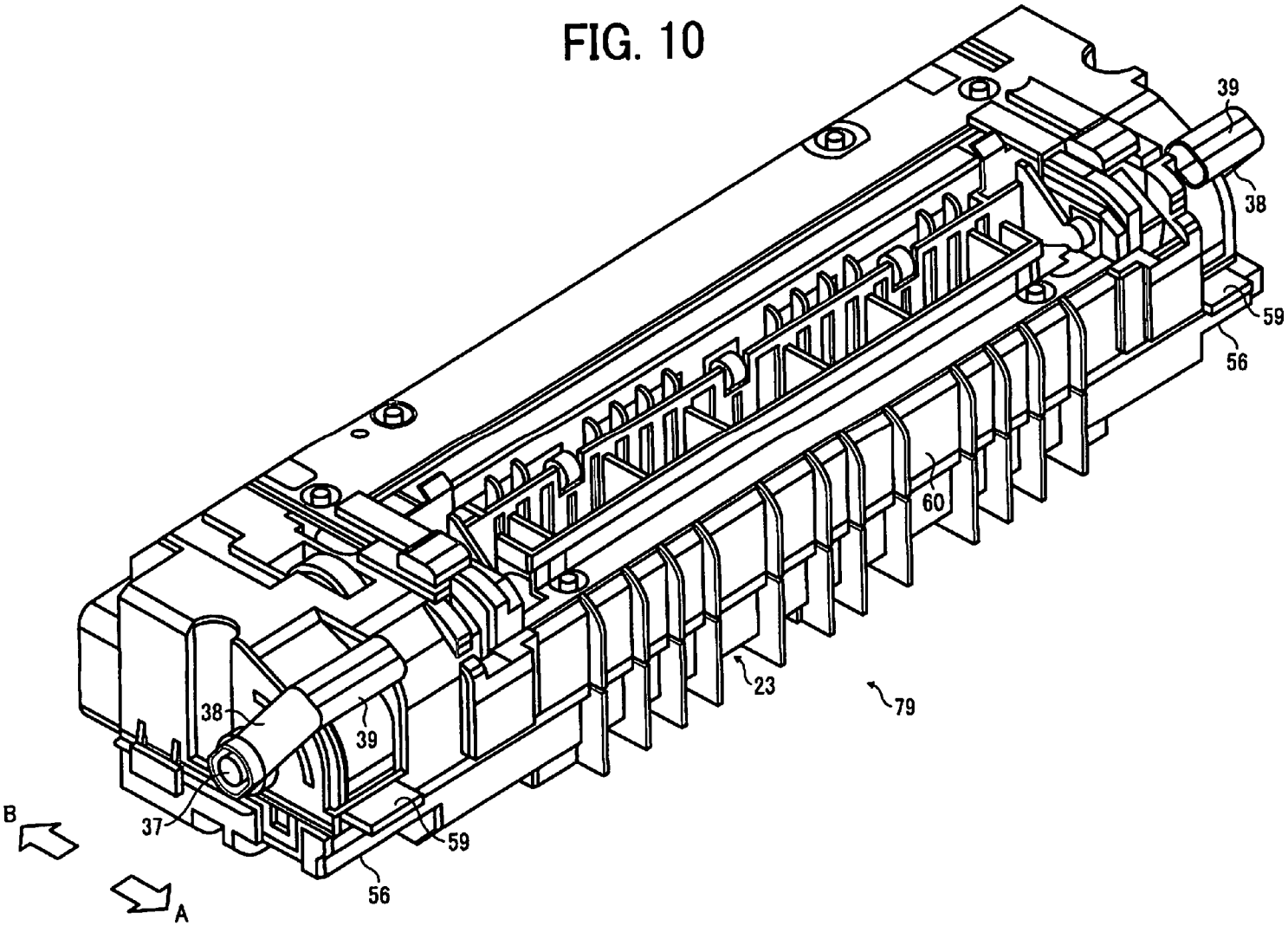
FIG. 10 is a perspective view of a fixing device according to a third embodiment of the present invention.
Figure 11:
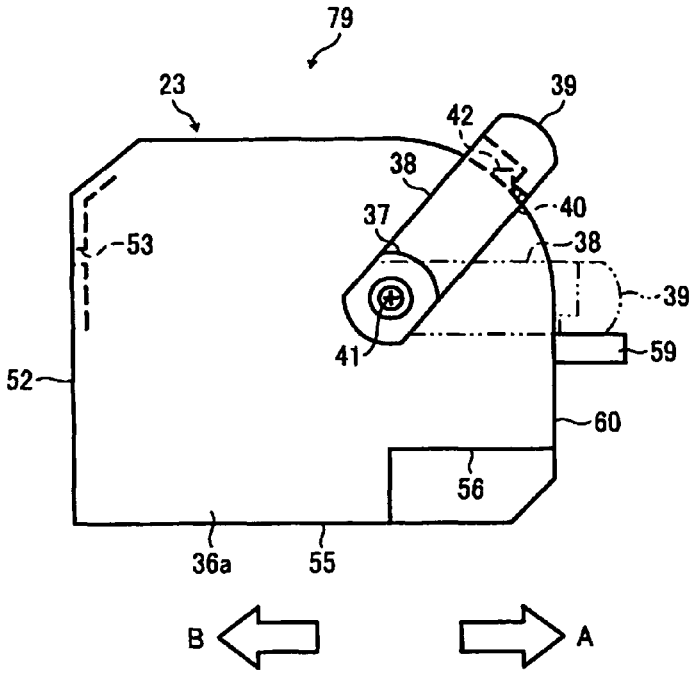
FIG. 11 is a side view of the fixing device according to the third embodiment.

FIG. 10 is a perspective view of a fixing device 79 according to a third embodiment of the present invention. FIG. 11 is a side view of the fixing device 79. The fixing device 79 includes two protruding members 59, 59 that are formed on the front surface 60 of the housing 23: one near the right side, and the other near the left side. The protruding member 59 is a small rectangle member. The protruding member 59 is integrally formed on the front surface 60 in a protruding manner. The protruding member 59 is arranged between the operating member 39 and the holding recession 56. When the switching lever 38 swings down, the operating member 39 is in contact with the protruding member 59, so that the switching lever 38 is held in the disengage position. The fixing device 79 does not include the lower stopper 43 shown in FIG. 4. Detailed descriptions of the components in FIGS. 10, 11 with the same reference numerals as those in FIGS. 3, 4 are omitted, because they have the same configuration.

Figure 12:
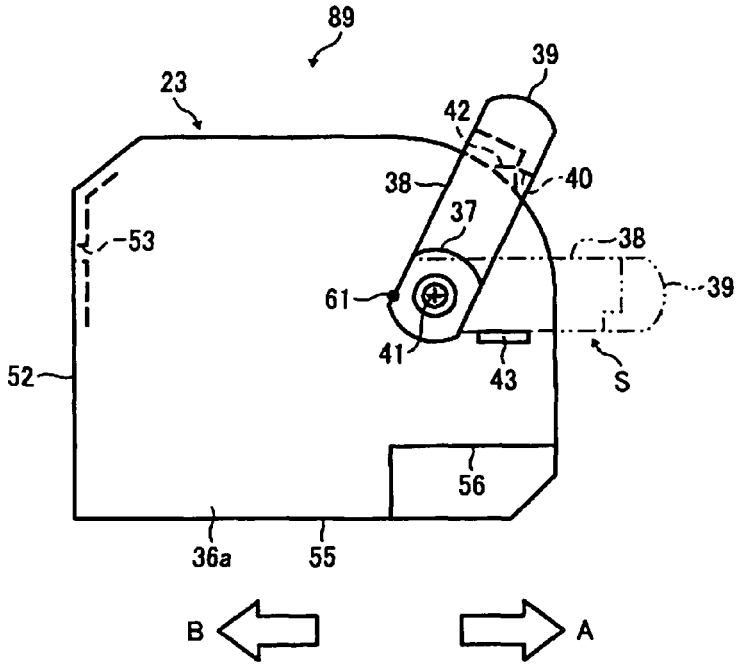
FIG. 12 is a side view of a fixing device according to a fourth embodiment of the present invention.

FIG. 12 is a side view of a fixing device 89 according to a fourth embodiment of the present invention. In the fixing device 89, the space S between the operating member 39 and the arc-shaped surface of the housing 23 increases when the switching lever 38 swings down to a lower position. Specifically, the fulcrum 41 is located forward of the center of curvature 61 of the arc-shaped surface of the housing 23. Configuration other than that shown in FIG. 12 can be employed. Detailed descriptions of the components in FIG. 12 with the same reference numerals as those in FIG. 4 are omitted, because they have the same configuration.

As shown in FIG. 2, when the front cover 32 is opened, the fixing device 19 is exposed to the outside. The fixing device 19 engages with the holding frame member 33. Specifically, the switching lever 38 is biased upward by the biasing unit, and the engaging member 37 engages with the engagement portion 44 of the slit 35 (see FIGS. 5 and 6B).

Figure 13:
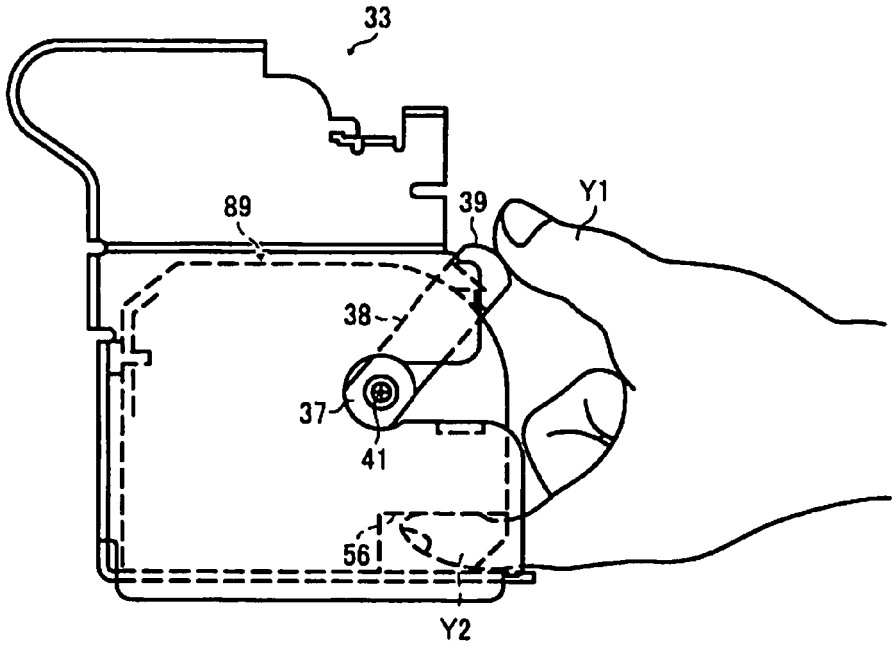
FIGS. 13 to 15 are schematic diagrams for explaining operation of detaching the fixing device according to the first embodiment from the holding frame member.
Figure 14:
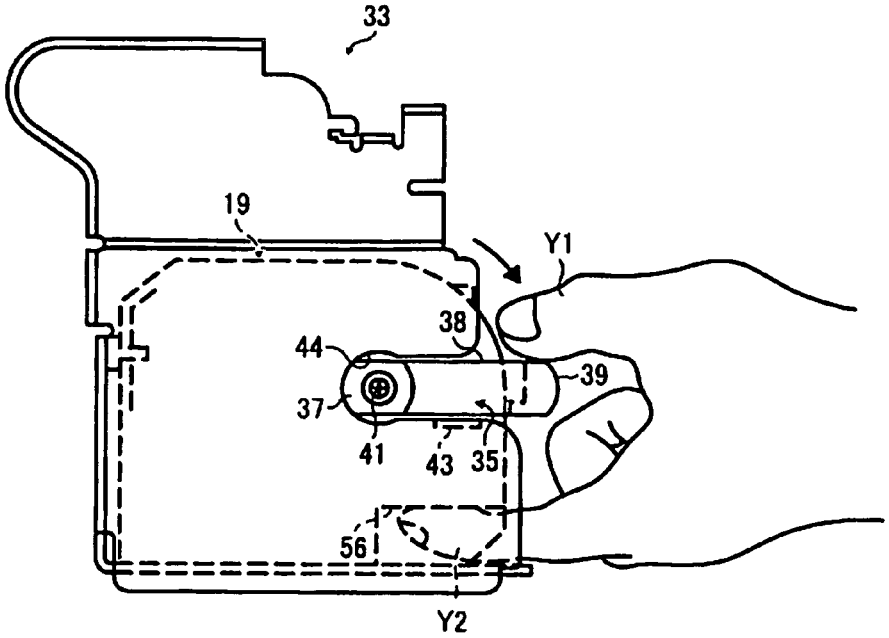
Figure 15:
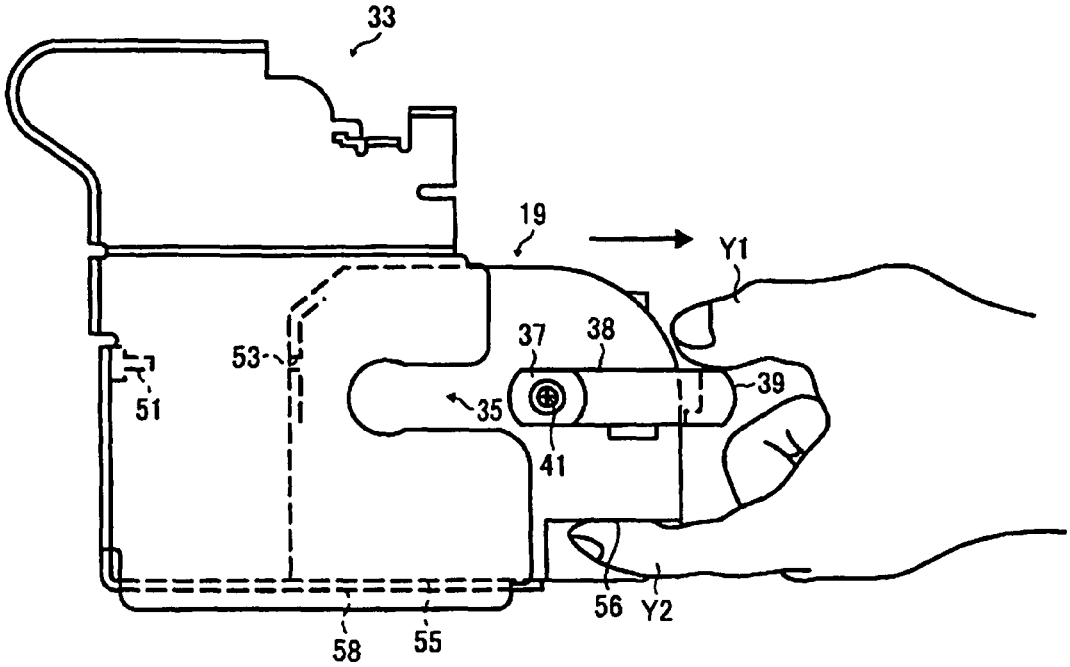

FIGS. 13 to 15 are schematic diagrams for explaining operation of detaching the fixing device 19 from the holding frame member 33. The user puts a left thumb Y1 on the operating member 39 on the user's left side. The user also puts a left forefinger Y2 inside the space K (see FIG. 8) formed between the holding recession 56 on the user's left side and the holding frame member 33. The user puts the left forefinger Y2 in such a manner that the first joint of the left forefinger Y2 is put inside the space K. The user makes the left finger Y2 to contact with the holding recession 56. Furthermore, the user puts a right thumb (not shown) on the operating member 39 on the user's right side. The user also puts a right forefinger (not shown) inside the space K formed between the holding recession 56 on the user's right side and the holding frame member 33. The user puts the right forefinger in such a manner that the first joint of the right forefinger is put inside the space K. The user makes the right finger to contact with the holding recession 56. In this manner, the user supports the fixing device 19 with the left and right forefingers. Therefore, it is possible for the user to hold the fixing device 19 in a stable manner even if the fixing device 19 is relatively heavy. The space K is set such that the user can hold the fixing device 19 in a manner as described above. In the following description, an operation performed with the left hand will be described, because the same operation is performed with the right and left hands.

FIGS. 14 and 15 are schematic diagrams for explaining operation of detaching the fixing device 19 from the holding frame member 33. As shown in FIG. 14, the user swings down the switching lever 38 with the thumb Y1 until the switching lever 38 is in contact with the lower stopper 43. In accordance with movement of the switching lever 38, the engaging member 37 rotates in the clockwise direction, and then lies horizontally. Thus, the engagement between the engaging member 37 and the engagement portion 44 is released.

As shown in FIG. 15, the user holds the fixing device 19 with the thumb Y1 and the forefinger Y2, and pulls out the fixing device 19 in the forward direction A while pressing down the switching lever 38 with the thumb Y1. When the fixing device 19 is pulled out in the forward direction A, the positioning pins 51, 51 are pulled from the positioning holes 53, 53, and the engaging member 37 is detached from the slit 35.

When the fixing device 19 is pulled in the forward direction A, the bottom surface 55 of the fixing device 19 (housing 23) slides on the bottom plate 58 of the holding frame member 33. Because the bottom plate 58 supports the weight of the fixing device 19, it is possible to easily pull out the fixing device 19 with the right and left thumbs and the right and left forefingers (from the tip to the first joint of the forefinger in contact with the holding recession 56).

After the fixing device 19 is detached from the holding frame member 33, the user can hold and move the fixing device 19 without moving the thumb Y1 and the forefinger Y2 to other positions.

When the fixing device 19 is pulled out from the holding frame member 33, a lateral side of the space K is opened. Therefore, the user can put the forefinger Y2 to a position deeper in the space K to tightly hold the fixing device 19. Specifically, the user puts the forefinger Y2 on a position deep in the space K by shifting a position of the base of the forefinger Y2 to the lateral side, so that the user tightly holds the fixing device 19 both from the front side and the lateral side. The user can easily slide out the fixing device 19 from the holding frame member 33 with the forefingers Y2 on a position close to the front side, because the bottom plate 58 supports the weight of the fixing device 19. After that, the user has to lift up the fixing device 19 without support by the bottom plate 58. Because the holding recessions 56 are formed on the corners between the front side and the lateral side, the user can change a direction from which the forefinger Y2 is inserted to the space K from the front side to the lateral side to lift up the fixing device. Thus, the user can stably hold the fixing device 19 with the finger Y2 on the deeper position, i.e., position closer to the center of gravity of the fixing device 19.

As described above, the user steadily holds the fixing device 19 with the thumb Y1 and the forefinger Y2, and supports the fixing device 19 from the bottom with the forefinger Y2. Therefore, the user can hold and move the fixing device 19 in a stable manner even if it is relatively heavy.

As described above, the fixing device 19 is configured such that, when the switching lever 38 swings down to the disengaged position, the operating member 39 approaches the holding recession 56. Specifically, a direction of force applied by the thumb Y1 for switching the switching lever 38 to the disengaged position is the same as that of force applied by the thumb Y1 for holding the fixing device 19. Therefore, the user can perform operations of switching the switching lever 38 and detaching the fixing device 19 from the holding frame member 33 in a smooth manner. When the switching lever 38 is in the disengaged position, the operating member 39 is located forward of the holding recession 56. Therefore, the user can put the thumb Y1 (short finger) on the operating member 39 located forward and the forefinger Y2 (long finger) on the holding recession 56 located backward in a natural manner. Thus, the user can hold the fixing device 19 in a stable manner.

While the fixing device 19 is detached from the holding frame member 33, the switching lever 38 is biased upward by the biasing unit, and is in the engaged position. The user puts the right and left forefingers Y2 on the holding recessions 56, 56 while the user puts the right and left thumbs Y1 on the operating member 39. The user then swings down the switching lever 38, and places the engaging member 37 in a horizontal direction.

While pressing down the operating member 39 with the thumbs Y1, the user holds the fixing device 19 with the thumbs Y1 and the forefingers Y2, and puts the fixing device 19 on the bottom plate 58 of the holding frame member 33 (FIG. 15). While holding the fixing device 19 with the thumbs Y1 and the forefingers Y2, the user slides the fixing device 19 on the bottom plate 58, and pushes the fixing device 19 in the backward direction B. The user pushes backward the fixing device 19 in a state that the fixing device 19 is supported by the bottom plate 58. Therefore, the user can hold the holding recession 56 with the tip of the forefinger Y2 (hold the front side of the holding recession 56). Furthermore, the user can take the forefinger Y2 off the holding recession 56, and place the forefinger Y2 in a natural position while pushing the fixing device 19. In this manner, the user can easily push the fixing device 19 in the backward direction B. When the fixing device 19 is pushed into the holding frame member 33, the positioning pin 51 are inserted into the positioning hole 53, and the contact base 54 is in contact with the back surface 52 of the fixing device 19 (see FIG. 5). Thus, the fixing device 19 is positioned with respect to the holding frame member 33 at the left, right, and back sides.

The engaging member 37 passes through the guide portion 45, and the engaging member 37 then is in contact with the engagement portion 44 (see FIG. 6A). When the operating member 39 is released from being pressed with the thumb Y1, the switching lever 38 swings up by the biasing unit. In accordance with the swing of the switching lever 38, the engaging member 37 rotates in the counterclockwise direction, thereby engaging with the engagement portion 44 (see FIG. 6B). Thus, the fixing device 19 engages with the holding frame member 33.

As described above, when the user attaches the fixing device 19 to the main body of the image forming apparatus, the user can perform operations of switching the switching lever 38 to the disengaged position and attaching the fixing device 19 to the holding frame member 33 in a smooth manner.

In the following description, an operation performed with the left hand will be described, because the same operation is performed with the right and left hands.

Figure 16:
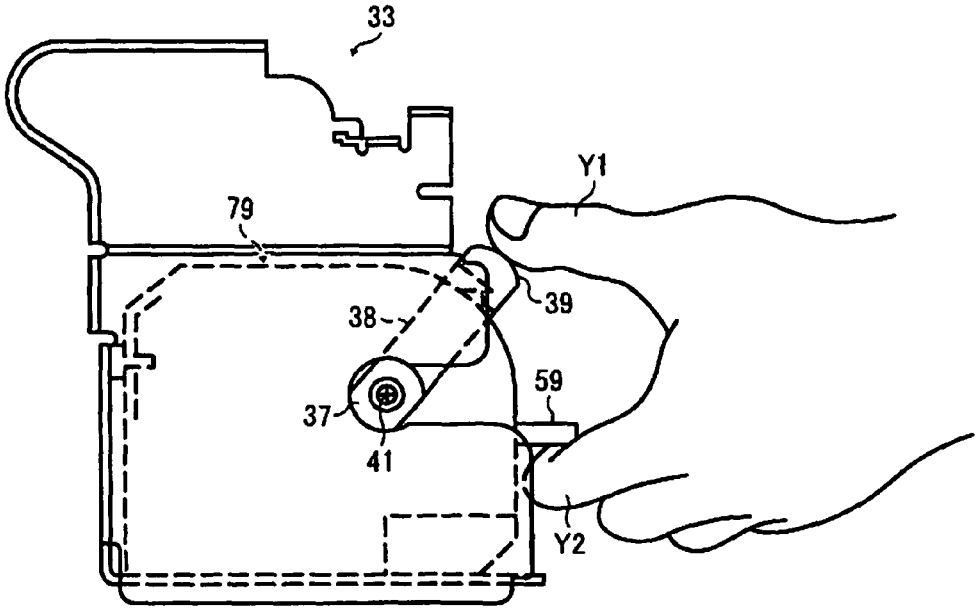
FIGS. 16 to 19 are schematic diagrams for explaining operation of detaching the fixing device according to the third embodiment from the holding frame member.

FIGS. 16 to 19 are schematic diagrams for explaining operation of detaching the fixing device 79 from the holding frame member 33 according to the third embodiment. The front cover 32 is opened, and the fixing device 79 is exposed to the outside (see FIG. 2). As shown in FIG. 16, the user puts the thumb Y1 on the operating member 39, and puts the forefinger Y2 in contact with the lower surface of the protruding member 59.

Figure 17:
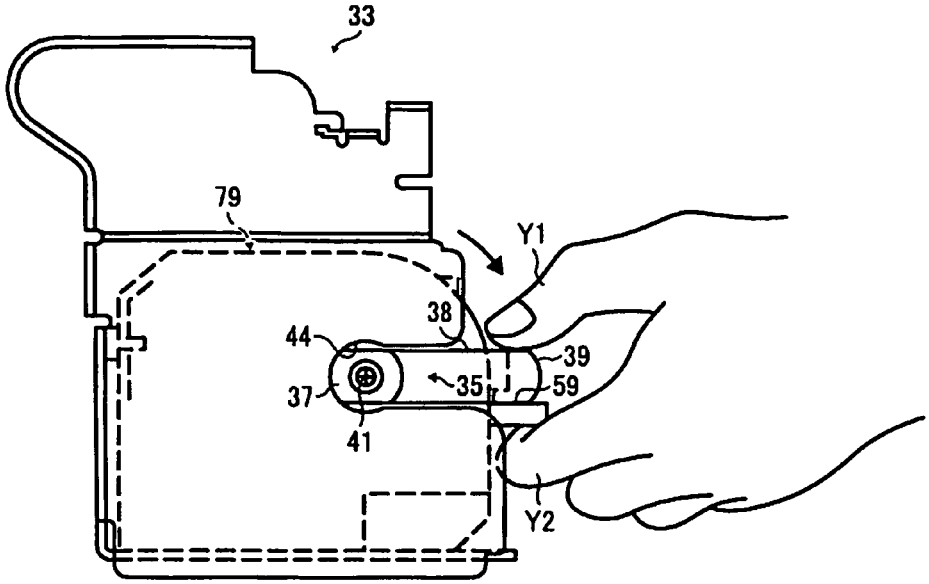

As shown in FIG. 17, the user presses down the switching lever 38 with the thumb Y1, so that the operating member 39 is in contact with the upper surface of the protruding member 59. In accordance with movement of the switching lever 38, the engaging member 37 rotates in the clockwise direction, and then lies horizontally. Thus, the engagement between the engaging member 37 and the engagement portion 44 is released.

Figure 18:
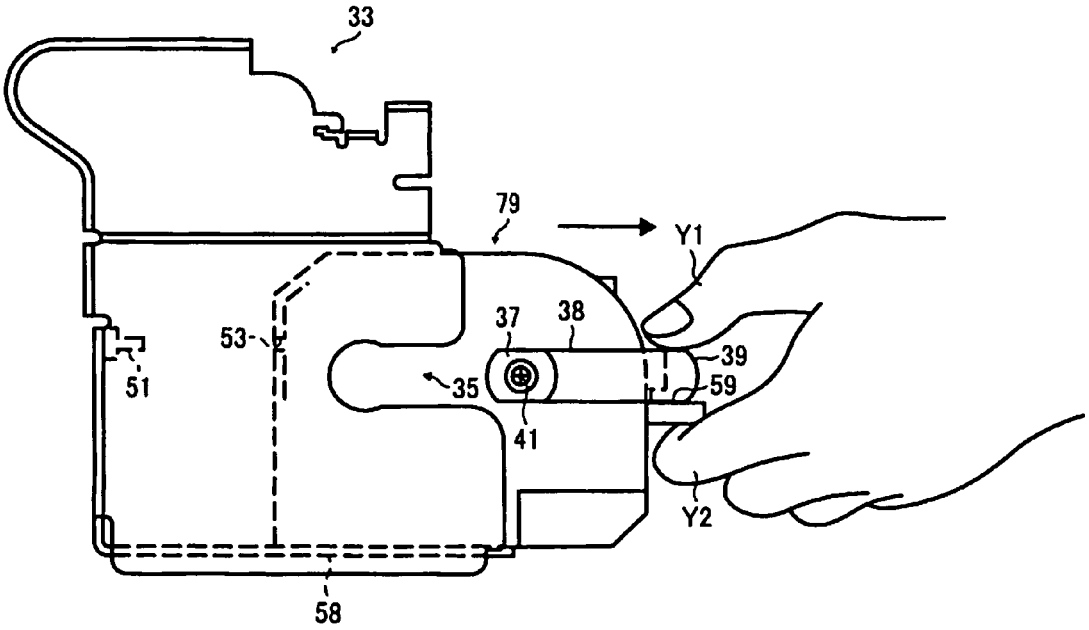

As shown in FIG. 18, the user pulls the fixing device 79 in the forward direction A while pressing the switching lever 38 against the protruding member 59 with the thumb Y1 and the forefinger Y2. When the fixing device 79 is pulled in the forward direction A, the positioning pin 51 is pulled out from the positioning hole 53, and the engaging member 37 is detached from the slit 35.

If the user lifts up the fixing device 79 while pressing the switching lever 38 against the protruding member 59 with the thumb Y1 and the forefinger Y2, a large load is applied to the thumb Y1 and the forefinger Y2 because the center of gravity of the fixing device is positioned backward of the position of the thumb Y1 and the forefinger Y2.

Figure 19:
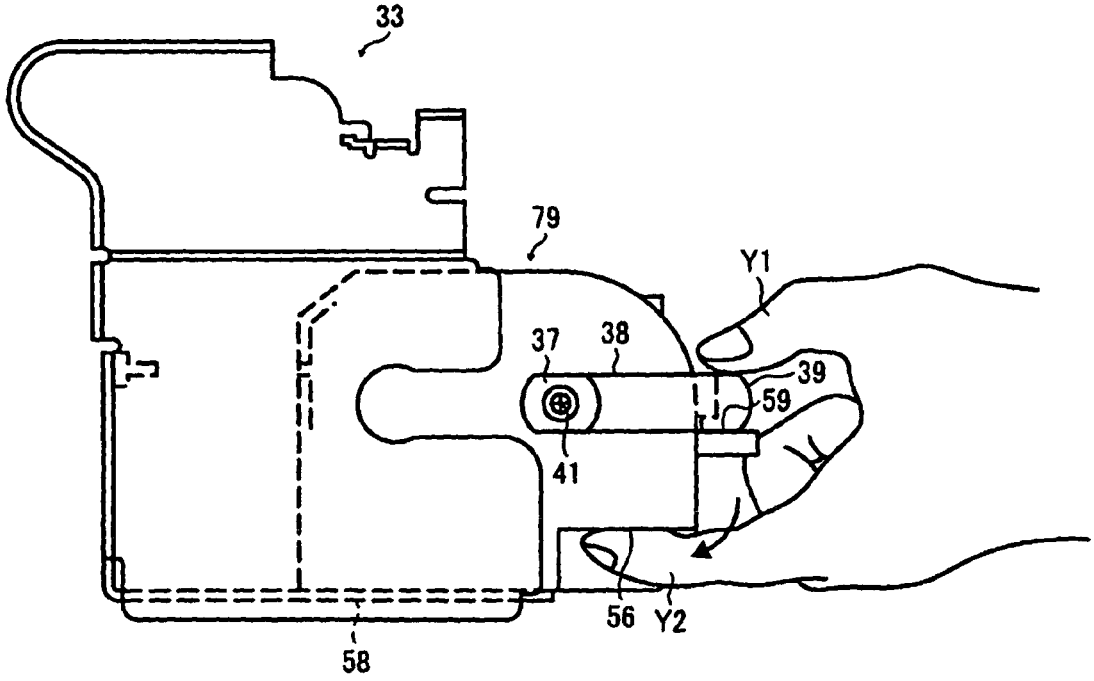

To solve the above-described problem, as shown in FIG. 19, the user moves the forefinger Y2 from the protruding member 59 to the holding recession 56 while the fixing device 79 is supported by the bottom plate 58. The holding recession 56 is held with the forefinger Y2, so that it is possible for the user to hold the fixing device 79 with the thumb Y1 and the forefinger Y2 in a stable manner, and easily detach the fixing device 79 from the holding frame member 33.

The fixing device 79 according to the third embodiment is attached to the main body of the image forming apparatus in the same manner as that of the first embodiment, and therefore description thereof is omitted.

When the user attaches/detaches the fixing device 89 according to the fourth embodiment to/from the main body of the image forming apparatus, the user puts the thumb Y1 on the operating member 39, and puts the forefinger Y2 in contact with the holding recession 56. In the fourth embodiment, the space S between the operating member 39 and the arc-shaped surface of the housing 23 increases when the switching lever 38 swings down to a lower position. If the user puts the tip of the thumb Y1 in the increased space S, the user can hold the fixing device 19 with the thumb Y1 and the forefinger Y2 in a steady and stable manner.

The present invention is not limited to the above-described embodiments, and various changes can be made within the scope of the present invention. For example, in the embodiments, the bottom plate 58 of the holding frame member 33 and the slit 35 (the guide portion 45) is arranged horizontally. However, the bottom plate 58 and the slit 35 can be inclined upward toward the forward direction A. Alternatively, the bottom plate 58 and the slit 35 can be inclined downward toward the forward direction A. If the bottom plate 58 and the slit 35 are inclined upward toward the forward direction A, it is easier to attach the fixing device 19 to the holding frame member 33. If the bottom plate 58 and the slit 35 are inclined downward toward the forward direction A, it is easier to detach the fixing device 19 from the holding frame member 33. Moreover, the holding recession 56 can be held, not only with the forefinger, but, for example, with the forefinger and a middle finger.

According to an aspect of the present invention, it is possible to perform operation of switching the engagement and disengagement between the housing and the main body of the image forming apparatus, and operation of detaching the housing from the main body in a smooth manner.

Furthermore, it is possible to hold the holding recession from the front side and the lateral side in an easy manner. The holding recession cannot be easily broken. The operability and stability of attaching/detaching the fixing device to/from the main body can be improved. The fixing device can be reduced in size, and the space for arranging the fixing device can be reduced.

Moreover, the fixing device can be supported from the bottom with a hand or a finger in contact with the holding recession, and therefore the fixing device can be held in a stable manner.

Furthermore, the housing can be held with both hands, and therefore the fixing device (housing) can be attached to or detached from the main body of the image forming apparatus in a stable manner.

Moreover, the operability of the engaging unit is improved. Even if the housing is heated to a high temperature due to heat generated upon a fixing operation, the heat of the housing is not easily transmitted to the operating member. Therefore, the operating member can be safely operated.

Furthermore, because the operating member is located forward of the holding recession, it is easy to hold the operating member and the holding recession.

Moreover, because the direction of force applied to the operating member upon switching the switching lever to the disengaged position is the same as that of force applied to the operating member upon holding the housing, the user can perform operations of switching the switching lever and holding the housing in a smooth manner.

Furthermore, because the switching lever is switched to the engaged position by the biasing unit when the switching lever is not operated, the operability of attaching/detaching the fixing device to/from the main body is improved.

When the user holds the housing by the operating member and the holding recession while the switching lever is in the disengaged position, a direction of the biasing force applied by the biasing unit is opposite to a direction of the holding force applied by the user. Therefore, the user can hold the housing in a stable manner.

Moreover, the operating member can be made longer, so that it is easier to hold the housing by the operating member. It is also possible to prevent the operating member from protruding from the housing, and therefore the fixing device can be reduced in size.

Furthermore, it is possible to hold the holding recession in a stable manner.

Moreover, it is possible to prevent the slip of the hand or the finger on the holding recession. Even if the housing is heated to a high temperature, the heat of the housing is not easily transmitted to the hand or the finger because the hand and the finger are in contact with the convex portions of the holding recession. Therefore, the holding recession can be held safely.

Furthermore, even if the housing is heated to a high temperature, the holding recession can be held safely because the hand and the finger are in contact with the heat insulating member arranged on the holding recession.

Moreover, when the switching lever is switched to the disengaged position, the housing can be pulled in the forward direction from the main body by holding the operating member and the protruding member without moving the hand or the finger to other positions. Thus, the user can perform operations of switching the switching lever and detaching the housing from the main body in a smooth manner.

Furthermore, the protruding member can function as a stopper that holds the switching lever in the disengaged position.

Moreover, the housing can be held by the operating member and the holding recession in a stable manner if the user puts the tip of the finger in the increased space between the operating member and the housing.

Furthermore, the fixing device can be applied to the image forming apparatus.

Moreover, it is possible to easily attach/detach the fixing device to/from the main body of the image forming apparatus.

Furthermore, when the user attaches/detaches the fixing device to/from the main body, the user put the hand or the finger in the space between the main body and the holding recession, thereby holding the holding recession.

Furthermore, the image forming apparatus including the fixing device can obtain the same effect as the fixing device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device configured to fix a toner image to a recording medium, the fixing device comprising:

a housing configured to be detachably attached to a main body of an image forming apparatus;

at least one engaging member configured to engage the housing with the main body in an engaged position and configured to disengage the housing from the main body in a disengaged position, wherein the at least one engaging member protrudes laterally outward;

at least one operating member coupled to the housing and configured to operate the at least one engaging member from the engaged position to the disengaged position or vice versa; and at least one grip integral with the housing and opposing the at least one operating member, the at least one grip being on a lower side of the at least one operating member, the grip being stationary with respect to the housing.

2. The fixing device of claim 1, wherein the at least one grip includes protrusions.

3. The fixing device of claim 2, wherein the at least one grip includes lateral protrusions.

4. The fixing device of claim 2, wherein the protrusions are parallel.

5. The fixing device of claim 2, wherein the protrusions are perpendicular to a detaching direction for the housing from the main body.

6. The fixing device according to claim 2, wherein a part of the at least one grip including the protrusions faces a lower side of the housing.

7. The fixing device of claim 1, wherein the at least one grip includes two grips.

8. The fixing device of claim 7, wherein at least one of the two grips is on a corner of the housing.

9. The fixing device of claim 1, wherein the at least one operating member and the at least one grip are on a front side of the housing.

10. The fixing device of claim 1, further comprising:

a biasing member configured to bias each operating member to operate a corresponding engaging member in the engaged position.

11. The fixing device of claim 10, wherein the biasing member is a coil spring.

12. The fixing device of claim 1, wherein each operating member is closer to a corresponding grip if a corresponding engaging member is in the disengaged position than if the engaging member is in the engaged position.

13. The fixing device according to claim 1, wherein the at least one grip has an exposed surface enclosing the housing.

14. The fixing device according to claim 1, wherein the housing is made of resin.

15. The fixing device according to claim 1, wherein at least a part of the at least one grip is formed into a fiat shape.

16. An image forming apparatus comprising a fixing device that fixes a toner image to a recording medium, the fining device including, a housing configured to be detachably attached to a main body of the image forming apparatus;

at least one engaging member configured to engage the housing with the main body in an engaged position and configured to disengage the housing from the main body in a disengaged position, wherein the at least one engaging member protrudes laterally outward;

at least one operating member coupled to the housing and configured to operate the at least one engaging member from the engaged position to the disengaged position or vice versa; and at least one grip integral with the housing and opposing the at least one operating member, the at least one grip being on a lower side of the at least one operating member, the grip being stationary with respect to the housing.

17. The image forming apparatus according to claim 16, wherein the main body of the image forming apparatus includes a supporting member that supports a weight of the fixing device during an operation of attaching or detaching the fixing device to or from the main body.

* * * * *